US005487351A

United States Patent [19]

Nedderman, Jr

[11] Patent Number: 5,487,351

[45] Date of Patent: Jan. 30, 1996

[54] CONTROL SURFACE FOR UNDERWATER VEHICLE

[75] Inventor: William H. Nedderman, Jr, Middletown, R.I.

[73] Assignee: The United States of America as represented by the Secretary of the Navy, Washington, D.C.

[21] Appl. No.: 372,080

[22] Filed: Jan. 13, 1995

[51] Int. Cl.[6] ..... B63G 8/18

[52] U.S. Cl. ..... 114/332; 114/126; 114/152; 114/162; 441/79; 244/45 A; 244/90 R; 244/219

[58] Field of Search ..... 114/332, 330, 114/126, 132, 140, 152, 162; 441/79; 244/45 A, 75 R, 90 R, 219

[56] References Cited

U.S. PATENT DOCUMENTS

| | | | |
|---|---|---|---|
| 4,280,433 | 7/1981 | Haddock | 114/126 |
| 5,114,104 | 5/1992 | Cincotta et al | 114/162 |
| 5,186,420 | 2/1993 | Beauchamp et al | 114/126 |

*Primary Examiner*—Jesus D. Sotelo

*Attorney, Agent, or Firm*—Michael J. McGowan; James M. Kasischke; Prithvi C. Lall

[57] ABSTRACT

A control surface for a vehicle comprising a flexible elastomeric body with its base joined to the vehicle to form a smooth surface, a rigid tip bar joined to the distal end of the body, and a control member for turning the rigid tip bar to bend the elastomeric body and generate lift. The control member can be a shaft which extends from the interior of the vehicle to said rigid tip bar to allow said shaft to rotate said tip bar.

10 Claims, 2 Drawing Sheets

CONTROL SURFACE FOR UNDERWATER VEHICLE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention generally relates to underwater vehicle control surfaces and more particularly to a flexible control surface having a nonconstant angle of attack.

(2) Description of the Prior Art

It is well known that control surface actuator noise and flow separation induced noise created by current "rigid" control surfaces are significant sources of unwanted noise on underwater and airborne vehicles. The rigid nature of these control surfaces increases the size of the turbulent wake behind the control surface thereby generating significant flow noise levels. The flow noise is created by two mechanisms: (1) the turbulence directly radiating to the near and far field, and (2) the induced noise caused by the turbulent excitation of the control surface and the surrounding structure. The latter causes surface and structure reradiation which is the dominant flow noise source.

One source of turbulence is the gap created when a rigid control surface is pivoted to change the course of the vehicle. Upon pivoting, a gap is created between the control surface and the base member. Water flow over this gap is turbulent and creates noise. Another source of turbulence is the shed vorticity and turbulent wake created by the rigid control surface. This induces turbulent excitation of the rigid control surface causing radiation of noise. Noise is also created when turbulent flow from the wake of the control surface is ingested by the propulsors, i.e., propellers, of the vehicle.

Recent inventions have been made to address the above difficulties. In U.S. Pat. No. 5,114,104 to Cincotta et al. a control surface was disclosed having a shape memory alloy actuator embedded in an elastomeric foil shape. This configuration did not provide an adequate deflection angle because of low mechanical advantage and space considerations. U.S. Pat. No. 5,186,420 to Beauchamp et al. corrected these problems by using a shape memory alloy at the base of the control surface. The '420 device proved to be unreliable because of varying environmental temperatures. Neither the '420 nor the '104 configuration can be a retrofit control surface aboard existing underwater vehicles because of gross design differences.

SUMMARY OF THE INVENTION

Accordingly, it is an object of the present invention to provide an improved control surface for use in producing lift forces to aid in the maneuvering of an underwater vehicle.

It is a further object of the present invention to provide a control surface that does not create a gap when the control surface is turned.

It is still a further object of the present invention to provide a flexible control surface having an elastomeric surface to prevent radiation of noise caused by turbulent excitation of the control surface.

It is yet another object of the present invention to provide a reliable, mechanically simple control surface that can be a retrofit on existing underwater vehicles.

Other objects and advantages of the present invention, will become more apparent hereinafter in the specification and drawings.

The above objects are realized by providing control surface for an underwater vehicle comprising a flexible elastomeric body with its base joined to the underwater vehicle to form a smooth surface, a rigid tip, bar joined to the distal end of the body, and a shaft that extends through the body to turn the rigid tip bar. The tip bar bends the elastomeric body which generates lift in the hydrodynamic flow field of the vehicle.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DESCRIPTION OF THE PREFERRED EMBODIMENT

Figure 1:
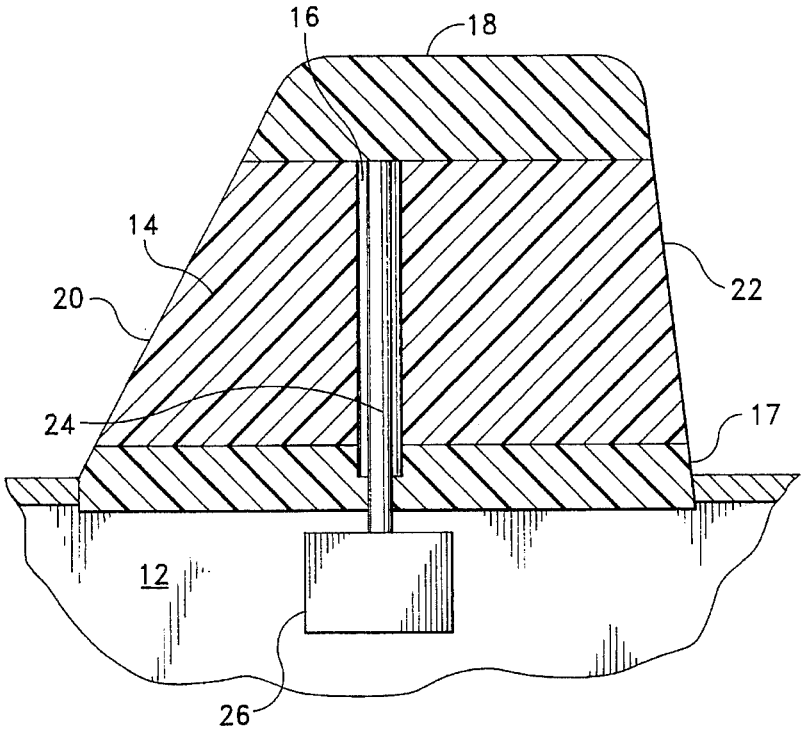
FIG. 1 shows a section view of the preferred embodiment of the inventive device.

Referring now to FIG. 1 there is shown a flexible control surface 10 mounted on an underwater vehicle 12. Control surface 10 has an elastomeric body 14 with a laminar cross section. Elastomeric body 14 has a channel 16 extending through body 14 from its base to the distal end. The base of elastomeric body 14 is joined to a rigid polyurethane mount 17 sunk within the outer hull of underwater vehicle 12 thereby forming a watertight seal between body 14 and vehicle 12. Rigid mount 17 has a laminar cross section and an aperture therein to correspond with the cross section and channel 16 of body 14. Mount 17 is recessed within vehicle 12 to provide better bonding between vehicle 12 and body 14. A rigid tip bar 18 is fixed to the distal end of elastomeric body 14. Rigid tip bar 18 is joined to elastomeric body 14 and extends from the leading edge 20 of control surface 10 to the trailing edge 22.

Tip bar 18 and body 14 are made from polyurethane although any elastomer with the necessary toughness and flexibility could be used. Tip bar 18 is a rigid polyurethane composition, and body 14 is a flexible polyurethane. Body 14 should be sufficiently rigid to maintain channel 16 at the operating depth of the control system. Optionally, channel 16 can be flooded with environmental water to equalize pressure. Polyurethane was chosen for both body 14 and bar 18 to allow secure bonding therebetween. Other materials can be used for elastomeric body 14 and tip bar 18, but materials having the required flexibility and bonding ability are necessary.

An actuator rod 24 is joined to an actuator 26 within vehicle 12. Actuator rod 24 can be made from any corrosion resistant rigid material; aluminum, titanium or stainless steel are preferred. Actuator rod 24 extends through vehicle hull 12 and passes through channel 16 in body 14 to join with tip bar 18. Actuator 26 rotates rod 24 in response to a control signal. Channel 16 provides sufficient clearance for rod 24 to rotate through a range of angles without contacting the walls of channel 16. Current underwater vehicles are equipped with similar actuators and actuator rods joined to a prior art rigid control surface.

Figure 2:
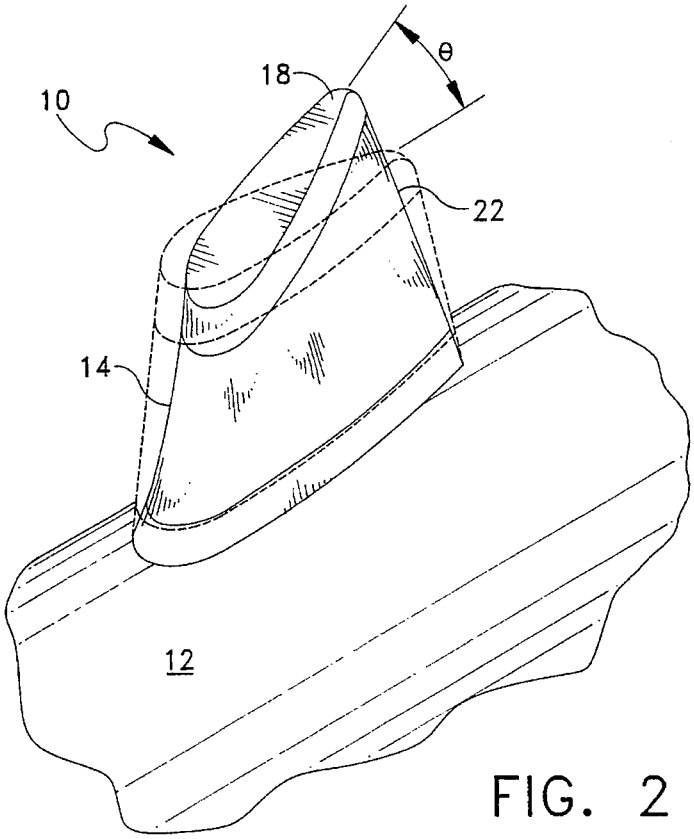
FIG. 2 shows a perspective view of the inventive device deformed to provide lift.

Referring now to FIG. 2 there is shown the inventive control surface 10 as turned to maneuver underwater vehicle 12. The undeformed orientation of control surface 10 is illustrated by dashed lines. To provide lift, actuator rod 24 (see FIG. 1) is rotated an angle θ. Rotation of rod 24 causes rotation of rigid tip bar 18 and results in deformation of elastomeric body 14. Deformed body 14 provides hydrodynamic lift to maneuver vehicle 12. Because the base of body 14 is rigidly fixed to undersea vehicle 12, body 14 deforms by angle θ near tip bar 18, but at it base body 14 only deforms slightly. The lesser angle of control surface attack near vehicle 12 prevents control surface 10 from interfering with laminar flow at the surface of vehicle 12. When rod 24 is rotated back to its neutral position, body 24 returns to its original form.

Figure 3:
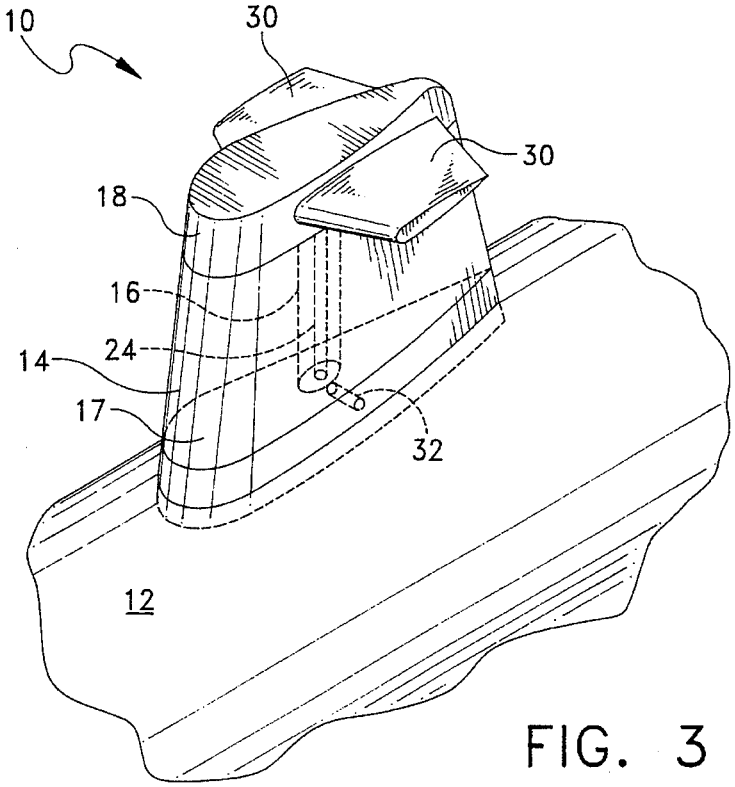
FIG. 3 shows an partially cut away perspective view of an alternate embodiment of the inventive device.

Referring now to FIG. 3 there is shown an alternate embodiment of control surface 10. This embodiment incorporates, two dihedral winglets 30 that are mounted on rigid tip bar 18 to prevent vortex shedding from the edge of control surface 10. Winglets 30 further reduce turbulence and act to quiet control surface 10. Mount 17 has a pressure compensation port 32 therein in communication with channel 16. Pressure compensation port 32 allows the introduction of sea water into channel 16 to equalize pressure when underwater vehicle 12 is operating at depth. Pressure compensation port 32 can be located anywhere allowing it to be in communication with the operating environment.

Figure 4:
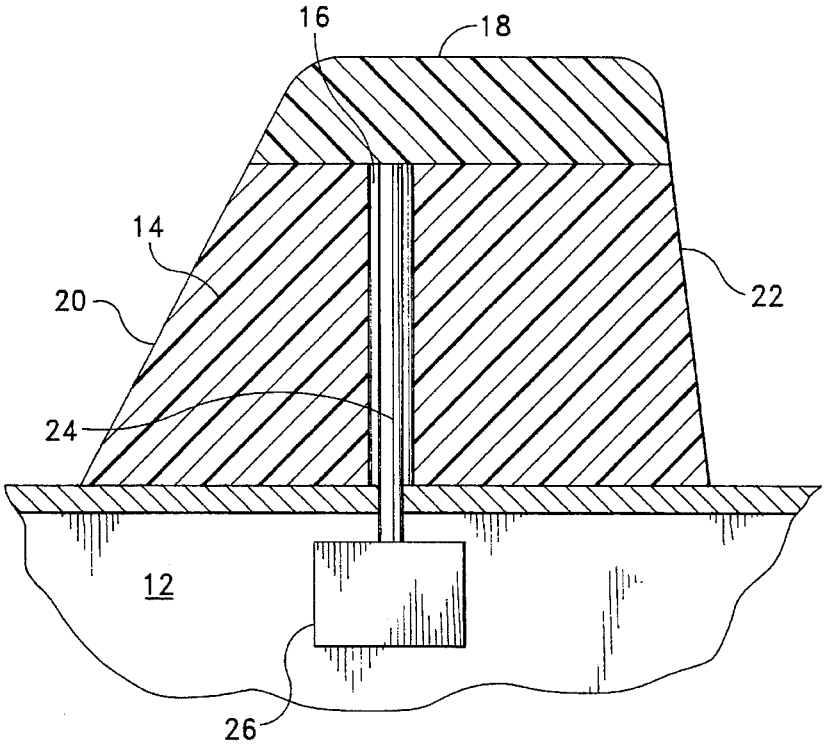
FIG. 4 shows a section view of another alternate embodiment of the inventive device.

Referring now to FIG. 4, there is shown an alternate embodiment of control surface 10. In this embodiment rigid mount 17 is omited and body 14 is joined directly to vehicle 12. The absence of mount 17 allows the control surface 10 to be retrofit on existing underwater vehicles 12 because the embodiment shown in FIG. 1 requires that mount 17 be positioned in a cavity formed in the surface of vehicle 12.

The advantages of the present invention over the prior art are that the inventive control surface reduces turbulence, prevents turbulent excitation caused by a rigid control surface, and can be a retrofit on existing underwater vehicles. Turbulence is reduced when the vehicle is maneuvering because the elastomeric body of the control surface is joined to the hull of the undersea vehicle. Turbulence is further reduced by providing a curving control surface which prevents a sudden flow change between the boundary layer of the vehicle's hull and the control surface. The flexibility of the control surface prevents turbulent excitation and reradiation from the control surface by providing additional damping. The inventive control surface can be a retrofit on existing underwater vehicles because it uses conventional control structures.

What has thus been described is a control surface for an underwater vehicle having a flexible elastomeric body with its base joined to the underwater vehicle to form a smooth surface, a rigid tip bar joined to the distal end of the body, and a shaft that extends through the body to turn the rigid tip bar. When the tip bar is rotated, it bends the elastomeric body and generates lift in the hydrodynamic flow field of the vehicle.

Obviously many modifications and variations of the present invention may become apparent in light of the above teachings. For example: the elastomeric body of the control surface can be any stiffness which allows the required angle of attack at the operating velocity and depth; as disclosed above, the control surface can have winglets to prevent vortex shedding; the control surface can be provided with a rigid elastomeric mount for affixing the control surface to the underwater vehicle; and control surface can be any shape having the desired hydrodynamic characteristics.

In light of the above, it is therefore understood that within the scope of the appended claims, the invention may be practiced otherwise than as specifically described.

What is claimed is:

1. A control surface system for a vehicle comprising:

a flexible elastomeric body having a distal end, a base end;

a channel therethrough extending from said base end to said distal end, said base end being joined to said vehicle;

a rigid tip bar joined to said distal end of said elastomeric body; and a shaft having a base end and a distal end, said shaft extending from the interior of said vehicle at said body base end through said channel in said body to said body distal end, said shaft distal end being joined to said rigid tip bar to allow said shaft to rotate said tip bar.

2. The control surface system of claim 1 further comprising an actuator connected to said shaft base end to rotate said shaft.

3. The control surface system of claim 2 wherein said elastomeric body has a pressure compensation port therein providing communication between said channel and the operating environment to equalize pressure between said channel and said environment.

4. The control surface system of claims.3 further comprising a pair of winglets extending from said tip bar in a direction generally perpendicular to said body to reduce vortex shedding from said body.

5. The control surface system of claim further comprising a rigid mount having an aperture therein, said mount being interposed between said vehicle and said elastomeric body base end.

6. The control surface system of claim 5 further comprising an actuator connected to said shaft base end to rotate said shaft.

7. The control surface system of claim 6 wherein said elastomeric body has a pressure compensation port therein providing communication between said channel and the operating environment to equalize pressure between said channel and said environment.

8. The control surface of claim 7 further comprising a pair of winglets extending from said tip bar in a direction generally perpendicular to said body to reduce vortex shedding from said elastomeric body.

9. The control surface system of claim 6 wherein said rigid mount has a pressure compensation port therein providing communication between said mount aperture and the operating environment to equalize pressure between said channel and said environment.

10. The control surface of claim 8 further comprising a pair of winglets extending from said tip bar in a direction generally perpendicular to said body to reduce vortex shedding from said elastomeric body.

* * * * *